US008896624B2

(12) United States Patent
Yamamoto

(10) Patent No.: US 8,896,624 B2
(45) Date of Patent: Nov. 25, 2014

(54) IMAGE DISPLAY DEVICE AND IMAGE PROCESSING METHOD

(75) Inventor: Kenji Yamamoto, Tokyo (JP)

(73) Assignee: NEC Display Solutions, Ltd., Tokyo (JP)

( * ) Notice: Subject to any disclaimer, the term of this patent is extended or adjusted under 35 U.S.C. 154(b) by 162 days.

(21) Appl. No.: 13/138,708

(22) PCT Filed: Mar. 30, 2009

(86) PCT No.: PCT/JP2009/056556
§ 371 (c)(1),
(2), (4) Date: Sep. 21, 2011

(87) PCT Pub. No.: WO2010/116467
PCT Pub. Date: Oct. 14, 2010

(65) Prior Publication Data

US 2012/0013632 A1 Jan. 19, 2012

(51) Int. Cl.
*G09G 5/00* (2006.01)

(52) U.S. Cl.
CPC ..... *G09G 5/00* (2013.01); *G09G 2320/0693* (2013.01); *G09G 2360/145* (2013.01)
USPC ..... 345/620; 345/619; 345/672; 345/681; 345/682; 345/684; 345/207

(58) Field of Classification Search
CPC .. G06T 15/30; G06T 3/20; G09G 2320/0261; G09G 2360/14; G09G 2340/0407
See application file for complete search history.

(56) References Cited

U.S. PATENT DOCUMENTS

| | | | | |
|---|---|---|---|---|
| 7,250,942 | B2 * | 7/2007 | Mitsumura et al. | 345/204 |
| 2007/0139678 | A1 | 6/2007 | Horita | |

FOREIGN PATENT DOCUMENTS

| | | | |
|---|---|---|---|
| CN | 1460918 | A | 12/2003 |
| CN | 101128794 | A | 2/2008 |
| JP | 2001-265296 | A | 9/2001 |
| JP | 2002-229546 | A | 8/2002 |
| JP | 2004-077516 | A | 3/2004 |
| JP | 2004-271866 | A | 9/2004 |
| JP | 2004-294637 | A | 10/2004 |
| JP | 2004-302124 | A | 10/2004 |
| JP | 2007-163979 | A | 6/2007 |
| JP | 2008-170509 | A | 7/2008 |
| JP | 2008-181109 | A | 8/2008 |
| JP | 2009-505263 | A | 2/2009 |

OTHER PUBLICATIONS

Miyajima (Japanese Patent 2002-229546, machine translation via PAJ website, http://www19.ipdl.inpit.go.jp/PA1/cgi-bin/PA1NUMBER , on Jun. 25, 2013).*
International Search Report dated May 19, 2009.
Chinese Office Action and Search Report dated Jul. 2, 2013 in Chinese Application No. 200980158411.0.
Japanese Office Action dated Jun. 17, 2014 with a partial English translation.

* cited by examiner

*Primary Examiner* — Antonio A Caschera
(74) *Attorney, Agent, or Firm* — McGinn IP Law Group, PLLC

(57) ABSTRACT

In order to make visible the image in a region which is hidden by an image sensor provided on a display unit when performing color calibration,
an image display device of the present invention includes
a sensor position detecting unit that detects a position on a screen where the image sensor is provided, and an image processing unit that displays, at another region on the screen, an image at the position on the screen that is detected by the sensor position detecting unit.

12 Claims, 6 Drawing Sheets

IMAGE DISPLAY DEVICE AND IMAGE PROCESSING METHOD

TECHNICAL FIELD

The present invention relates to an image display device such as a liquid crystal display and a plasma display, and in particular relates to an image display device and an image processing method that performs image processing in relation to a portion in which display of the screen is hidden by an image sensor or an obstruction that is installed on the image display portion.

BACKGROUND ART

In an image display device such as a liquid crystal display and a plasma display, color calibration is performed. Color calibration involves measuring the brightness and color of an image using a brightness sensor and color sensor, and correcting the image display in accordance with the measurement result. In this way, for example Patent Documents 1, 2, and 3 given below disclose constitutions that provide an image sensor such as an optical sensor or the like in a liquid crystal display or the like.

[Patent Document 1] Japanese Unexamined Patent Application, First Publication No. 2001-265296

[Patent Document 2] Japanese Unexamined Patent Application, First Publication No. 2008-170509

[Patent Document 3] Japanese Unexamined Patent Application, First Publication No. 2008-181109

DISCLOSURE OF INVENTION

Problem to be Solved by the Invention

However, in an image display device such as a liquid crystal display and a plasma display, when a brightness sensor or a color sensor is installed on the screen display portion, the problem arises of a region that originally should display an image being hidden.

Also, although it is possible make these sensor portions movable to enable them to be concealed in the chassis away from the screen during normal use, since it is necessary to arrange them on the screen during measurement, there has been the problem of a partial region of the screen not being visible to the user due to the sensors.

Also, in the case of a projector, a person standing in the projection causes a shadow to be cast on the screen, which leads to the problem of interference with the screen display.

The present invention provides an image display device and an image display method that makes visible the display region of the screen that is hidden by sensors or the like in order to solve the aforementioned problems.

Means for Solving the Problem

In order to solve the aforementioned issues, the present invention includes a sensor position detecting unit that detects a position on a screen where an image sensor is provided; and an image processing unit that displays, at another region on the screen, an image at the position on the screen that is detected by the sensor position detecting unit.

Also, In the present invention, the image processing unit may perform display corresponding to a first image data on the screen, performs display corresponding to a second image data on a portion of the screen, and sequentially change a position of displaying an image corresponding to the second image data within the image; and the sensor position detecting unit may judge whether or not a detection result corresponding to the second image data is obtained based on a detection result of the sensor position detecting unit, and in a case of the detection result corresponding to the second image data being obtained, the sensor position detecting unit may detect that a position on the screen where the second image data is displayed when the detection result corresponding to the second image data is obtained, is a position on the image where the image sensor is provided.

Also, there may be provided a pointer detecting unit that detects a position of a pointer that is displayed on the screen, and when the position of the pointer detected by the pointer detecting unit overlaps with the position of the image sensor detected by the sensor position detecting unit, the image processing unit may display, at another region on the screen, an image of the position on the screen detected by the sensor position detecting unit.

Effect of the Invention

According to the present invention, since the image corresponding to the position of the image sensor is displayed at another region on the display screen, it is possible to make visible the image display that has been hidden by the image sensor.

Also, when measuring with an image sensor that is provided externally, it has not been possible to make visible the screen that is hidden by the image sensor, but in the present invention, during measurement, it is possible to visibly display the image of the position where the image sensor has been provided.

Also, the present invention, by measuring the sensor position automatically, there is the point of being able to accommodate sensors of various types.

REFERENCE SYMBOLS

Figure 1:
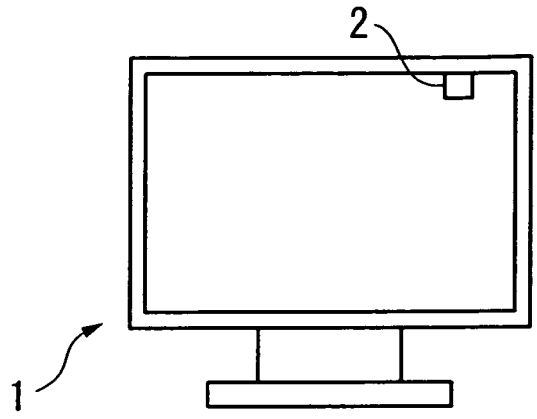
FIG. 1 is an external view of an image display device that mounts an image sensor on a screen.

1 Display device
10 Image sensor
30, 35 Control unit
31 Sensor position detecting unit
32 Pointer detecting unit
40 Position data storage unit
50 Image processing unit
70 Display unit Best Mode For Carrying Out The Invention Hereinbelow, an image display device according to one exemplary embodiment of the present invention shall be described with reference to the drawings. In this exemplary embodiment, an image display device in which an image sensor is installed shall in particular be described.

This image display device is for example a liquid crystal display or a plasma display, and performs image processing in relation to a portion in which display of the screen is hidden by an image sensor or an obstruction that is installed on the image display portion, and by displaying that hidden image at another location on the display screen, transmits the display content so as to be visible.

FIG. 1 is an external view of an image display device of a type that is called a built-in type in which the image sensor 2 is mounted on the screen. In the case in which the installed position of the image sensor 2 is fixed, since the position information of the sensor is also fixed, it is possible to manually set the position information.

Figure 2:
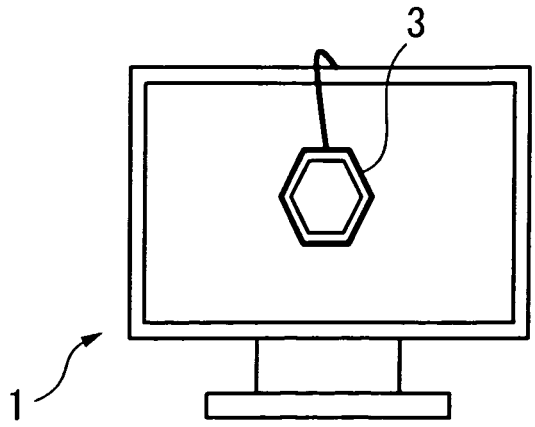
FIG. 2 is an external view of an image display device in which an image sensor is installed as an external device, and that performs measurement of brightness and chromaticity in the middle of a screen.

FIG. 2 is an external view of an image display device that is of a type that is called an external measurement type, in which the image sensor 3 is installed as an external device that performs measurement of the brightness and chromaticity in the middle of the screen.

Although cases of setting the position manually and cases of setting it automatically are considered as the sensor position detecting means at this time, in the case of using a general-purpose sensor device whose size is decided to an extent, since the rough measurement position and size are known in advance, it is possible to input the position coordinates manually.

Figure 3:
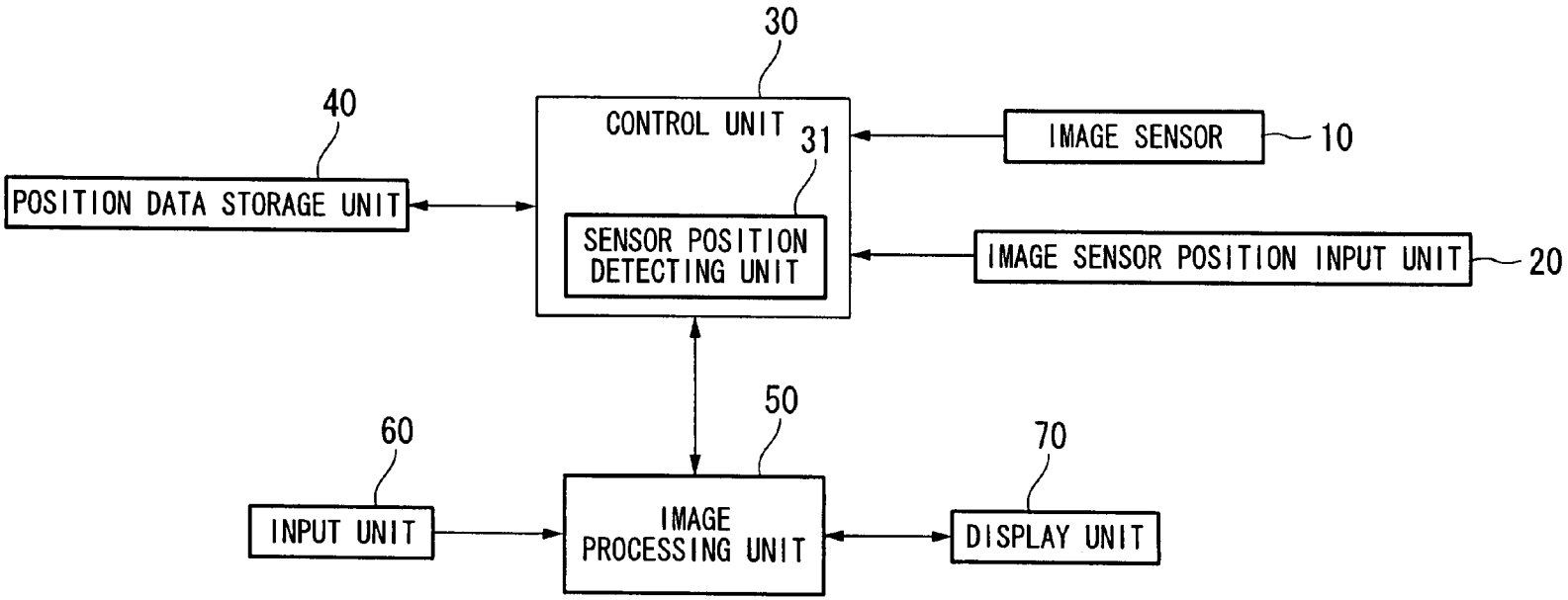
FIG. 3 is an outline block diagram that shows the constitution of an image display device of one exemplary embodiment of the present invention.

FIG. 3 is an outline block diagram that shows the constitution of the image display device of the exemplary embodiment of the present invention.

The image display device 1 includes an image sensor 10, an image sensor position input unit 20, a control unit 30, a position data storage unit 40, an image processing unit 50, an input unit 60, and a display unit 70.

The image sensor 10 detects the image displayed on the display screen of the image display device 1. For example, it detects the brightness or chromaticity of an image in the detection target region. This detection target region is a region containing a plurality of pixels or one pixel.

The image sensor position input unit 20 receives an input of position data showing this installed position, when the image sensor 20 is installed in a fixed manner.

The control unit 30 has a sensor position detecting unit 31. The sensor position detecting unit 31 detects the position on the screen at which the image sensor 10 is provided. The sensor position detecting unit 31 judges whether or not a detection result corresponding to the second image data has been obtained based on the detection result of the sensor position detecting unit 31, and in the case of a detection result corresponding to a second image data being obtained, it detects that the position on the screen where second image data is displayed in the event of the detection result corresponding to the second image data being obtained is the position on the image where the image sensor has been provided. The first image data is the image data that is made to be displayed on the entire display screen of the image display device, and brightness or chromaticity thereof is decided beforehand. The second image data is image data that is made to be displayed on a portion of the first image data, and is image data in which the brightness or chromaticity differs from the first image data.

The position data storage unit 40 stores the position information showing the position at which the image sensor 10 has been provided. The coordinate data on the display screen according to the position at which the image sensor 10 is provided is stored, for example, as the position information.

The image processing unit 50 displays the image of the position on the screen detected by the sensor position detecting unit 30 at another region on the screen.

Moreover, the image processing unit 50, in addition to performing display of the screen in accordance with the first image data, performs display of a portion of the screen in accordance with the second image data, and performs the display by sequentially changing the position that displays the image corresponding to the second image data within the image.

Moreover, in the case of the position of the pointer that a pointer detecting unit 32 has detected overlapping with the position of the image sensor that the sensor position detecting unit 31 has detected, the image processing unit 50 displays the image of the position on the screen detected by the sensor position detecting unit 32 at another region on the screen. The control unit 30 judges whether or not this position overlaps, and the image processing unit 50 inputs this judgment result.

The input unit 60 receives the input of the designation which selects the image display method, and inputs the specified image display method into the image processing unit 50. As this image display method, the user can freely turn ON/OFF a function (a function that displays the image corresponding to the position of the image sensor at another region), or can select a preferred image processing method. Also, as one example of this image processing selection means, means for detecting the position of the mouse pointer may be provided, a function may be selected that only performs image processing in the case of the mouse pointer overlapping with the position of the image sensor.

The display unit 70 is for example a liquid crystal panel, and displays various images.

Figure 4:
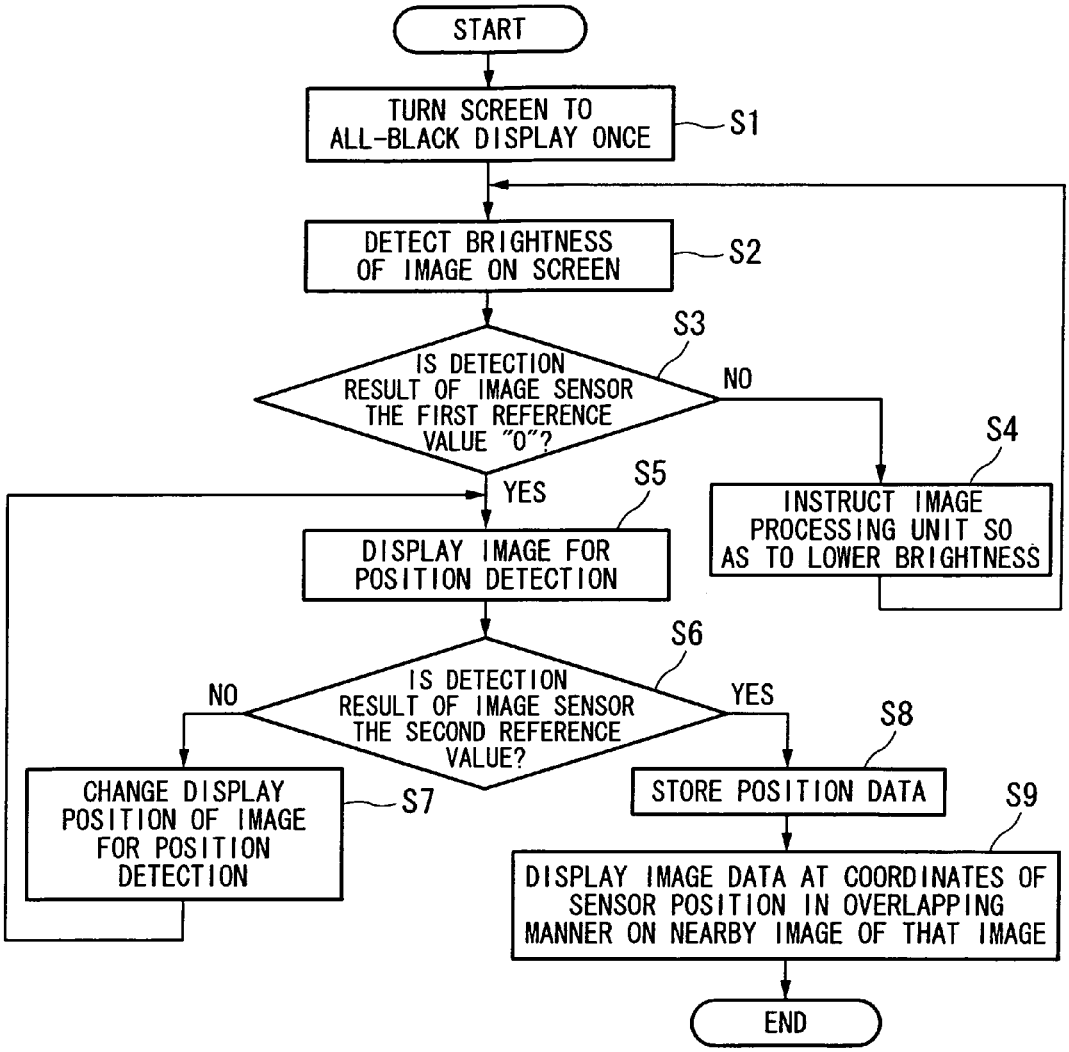
FIG. 4 is flowchart that describes the operation of the image display device 1.

Next, the operation of the image display device 1 in the configuration of FIG. 3 shall be described using the flowchart of FIG. 4.

First, the control unit 30 outputs an instruction to the image processing unit 50 so that the display of the screen becomes entirely black. The image processing unit 50 once makes the screen an all-black display based on the instruction from the control unit 30 (Step S1).

The image sensor 10 detects the brightness of the image on the screen of the display unit that has been made an all-black display at a potion where it has been installed (Step S2). The control unit 30 takes in the detection result of the image sensor 10, and judges whether or not the detection result, that is, the detection result of the image sensor 10 is "0" that is the first reference value (Step S3).

When the detection result of the image sensor 10 is not "0", it instructs the image processing unit 50 to change the display content. For example, in the case of a value of 1 or more being detected by the image sensor 10, the control unit 30 outputs an instruction to the image processing unit 50 to lower the brightness (Step S4), causes the image to be displayed again, and proceeds to Step S2.

On the other hand, in the case of the detection result of the image sensor 10 being "0", the control unit 30 outputs an instruction to the image processing unit 50 to display an image for position detection of the image sensor 10 (Step S5). The image processing unit 50, upon receiving this instruction, draws on the display unit 70 a rectangular region image with a white display in multiple-dot units as an image for position detection in a portion of the screen where the all-black display is being performed, and scans (moves) from the screen edge of the display unit 70.

Next, the control unit 30 judges whether or not the detection result of the image sensor 10 is the second reference value (Step S6). Here, in the case of the image for position detection being outside the region where the sensor 10 detects the brightness, "0" is input as the detection result from the image sensor 10. In this case, the control unit 30 instructs the image processing unit 50 to further change the position of the position detection image (Step S7).

Meanwhile, the display position of the image for position detection is sequentially changed, and in the case of the image for position detection being positioned in the region where the image sensor 10 detects the brightness, the image sensor 10 outputs a detection result of this image for position detection (for example "180") to the control unit 30. The control unit 30, upon receiving this detection result, instructs the image processing unit 50 to stop movement of the image for position detection. The image processing unit 50 receives this instruction to stop movement of the image for position detection, and outputs the position data that shows the coordinates at which this detected image for position detection is displayed to the control unit 30. The control unit 30 stores the position data that is output from the image processing unit 50 in the position data storage unit 40 (Step S8).

When the position data is stored, the control unit 30 measures by a microcomputer or the like the sensor position that has been detected, and notifies the image processing unit 50 of the coordinates of the detected sensor position, and instructs the image processing unit 50 so as to perform image processing on the image data at the coordinates of the detected sensor position and the surrounding image data.

The image processing unit 50, upon receiving this instruction, displays the image data at the coordinates of the sensor position in an overlapping manner on a nearby image of that image (Step S9).

Figure 5:
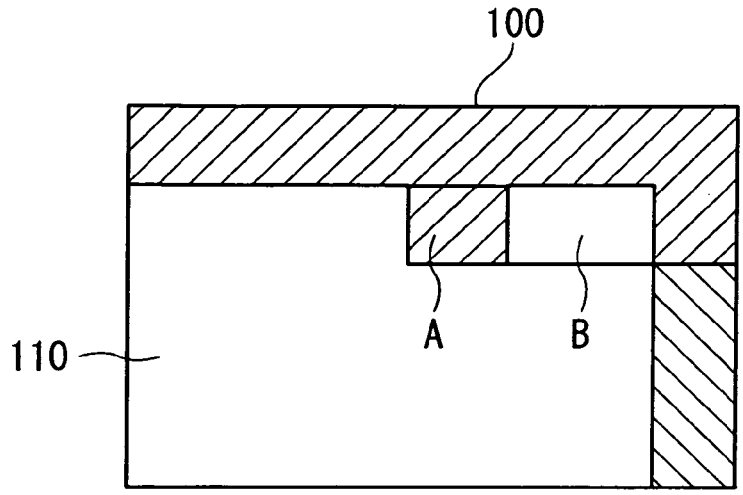
FIG. 5 is a view that shows the case of an image sensor being arranged at a position adjacent to a chassis 100.
Figure 6:
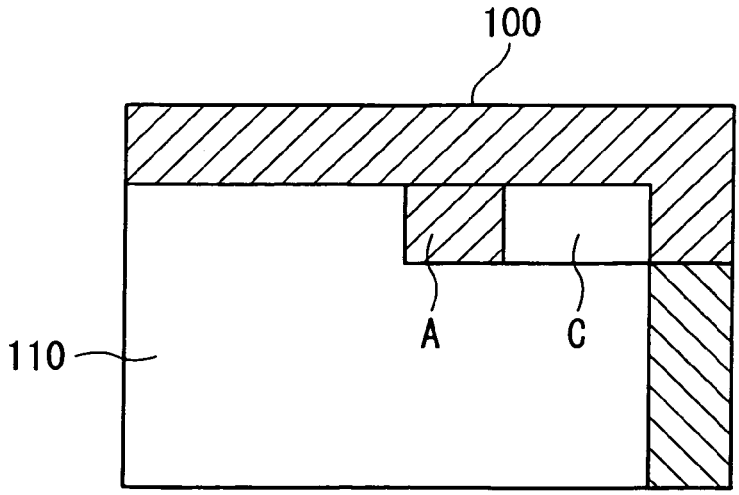
FIG. 6 is a view that shows the display screen in the case of displaying a generated image C at a region B.

Next, using FIG. 5 and FIG. 6, the display screen 110 of the image display device 1 shall be described. FIG. 5 is a view that shows the case of the image sensor 10 being arranged at a position that is contiguous with the chassis 100. In this figure, the region A denotes the position of an image where the image is not visible due to arrangement of the image sensor 10. The region B denotes the position of an image that is contiguous with the region A.

Here, the region A that is not visible due to the image sensor 10 corresponds to the position data. Accordingly, the image processing unit 50 specifies the region B that is contiguous with the position data, and by computing the difference between the total display region and the region A, calculates the image size of the region B. Then, it computes the image size of this calculated region B, and the image size of the region A, and generates an image C that reduces the obtained total image size so as to become the image size of the region B, and displays that generated image C as image C at region B. FIG. 6 is a view that shows the display screen 110 in the case of displaying the generated image C at the region B.

Thereby, since the region "A" that is the region of the image that is not visible due to the image sensor 10 is made to be displayed on the screen at a region where the image sensor 10 is not arranged, it is possible to make visible the image of the region that is not visible due to the image sensor 10.

Note that, here, the image of the region A and the image of the region B were reduced and displayed at region B as image C, but the image of the region A may also be displayed at region B. For example, in the case of there being a region on the screen in which particularly important information is not displayed, by designating that region as region B, it is possible to display the image of region A at region B. Thereby, compared to the case of reducing the image including the image of region B, it is possible to display the image of region A without much reduction, which facilitates visibility.

Also, in the aforementioned exemplary embodiment, the position at which the image of region A is displayed is not limited to region B, that is, to the contiguous right side, and it is possible to display it by designating an arbitrary position on the screen other than the region A.

The process of reducing this image can be performed by various image processing, so a description of it shall be omitted.

In the exemplary embodiment described above, a description was given for the case of displaying an image corresponding to the position of the image sensor 10 at a contiguous position, as an example of displaying it at another region. However, with regard to which position it is to be displayed, the input unit 60 may receive an input that designates the display position, and the image processing unit may perform the display in accordance with it.

Also, in the exemplary embodiment described above, it is possible to make the size of the rectangular region image of the image for position detection any size, and for example, if the size of the image is increased, it is possible to increase the movement amount. Therefore, although the accuracy of specifying the position of the image sensor 10 is not high, it is possible to shorten the measurement time. On the other hand, if the size of the image is made smaller, since the movement amount decreases, more time is required for movement, but it is possible to improve the accuracy of specifying the position of the image sensor 10. Also, the movement amount of the image for position detection may be in 1-dot units or multiple-dot units. Also, the movement direction of the image for position detection may be arbitrarily determined. For example, in the case of being moved rightward from the upper left of the screen, and moved to the right edge, it may be moved from the left to the right one step downward.

Figure 7:
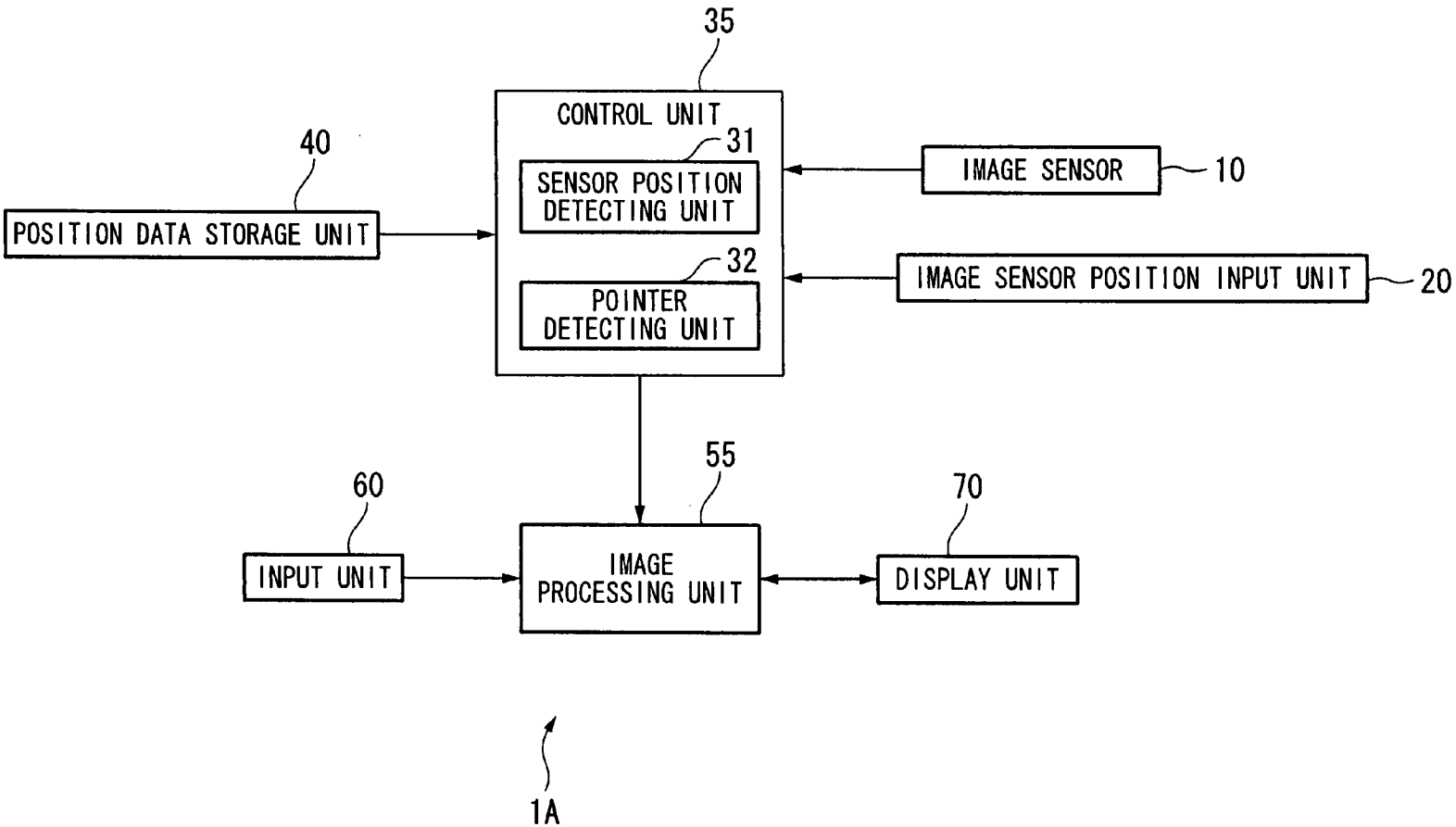
FIG. 7 is an outline block diagram that shows the configuration of an image display device in another exemplary embodiment.

Next, another exemplary embodiment shall be described. FIG. 7 is an outline block diagram that shows the configuration of an image display device 1A in the other exemplary embodiment.

In FIG. 7, the portions corresponding to FIG. 3 are denoted by the same reference symbols, and so explanations thereof shall be omitted. A pointer detecting unit 32 detects the position of a pointer that is displayed on the screen of the display unit 70.

In the case of the position of the pointer detected by the pointer detecting unit 32 overlapping with the position of the image sensor that the sensor position detecting unit 31 has detected, an image processing unit 55 renders the image of the position on the screen detected by the sensor position detecting unit 31 so as to be displayed at another region on the screen.

The control unit 35 compares the coordinate of the pointer drawn by the image processing unit 55 and the position data that expresses the coordinates where the image sensor 10 is arranged, and judges whether or not the pointer is in the region where the image sensor 10 is positioned (for example, region A). In the case of the pointer being in the region where the image sensor 10 is positioned, it outputs to the image processing unit 55 that the position of the pointer and the position of the image sensor overlap.

Figure 8:
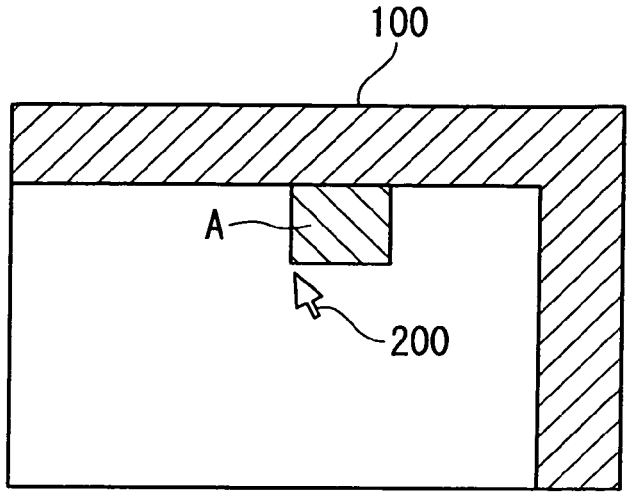
FIG. 8 is a view that shows an example of a. screen that is displayed in the display device 1 in the other exemplary embodiment.
Figure 9:
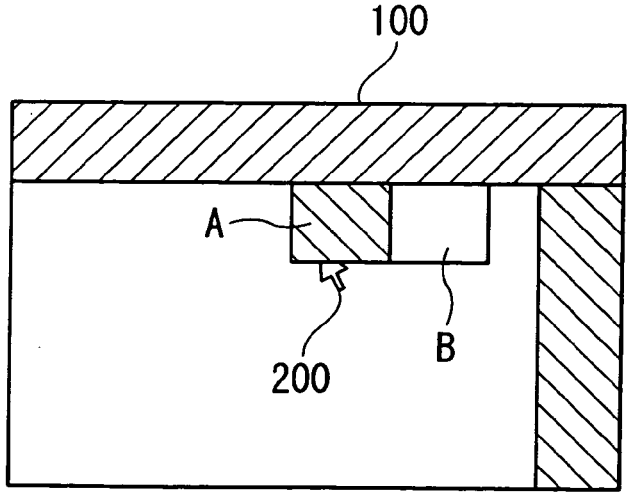
FIG. 9 is a view that shows an example of a screen that is displayed in the display device 1 in the other exemplary embodiment.

A further description shall be given using FIG. 8 and FIG. 9. FIG. 8 and FIG. 9 are views that show examples of a screen that is displayed on the display device 1 in the other exemplary embodiment.

As shown in FIG. 8, the control unit 35 compares the position of a mouse pointer 200 of a mouse that is operated by a user, and a region A in which the image sensor 10 is positioned, and judges whether or not they overlap. Since they do not overlap in FIG. 8, the control unit 35 displays the image as usual without outputting any particular instruction to the image processing unit 55.

In the case of the position of the mouse pointer 200 and the region A overlapping as shown in FIG. 9, the control unit 35 outputs to the image processing unit 55 that the mouse pointer 200 and the region A overlap. The image processing unit 50, upon receiving this, then displays the image that should displayed in region A in region B that is contiguous with it.

In this exemplary embodiment, as position detection of the mouse pointer 200, the sensor position information may be sent and set to a graphics board of a computer that the image display device 1 is connected to, or in the case of performing it at the image display device side, it may have the hotspot position of the mouse pointer 200 transmitted from the computer, compare it with region A, and make a judgment, or it may be detected by performing image recognition at the image display device side.

In the exemplary embodiments described above, the display device 1 was described as being a liquid crystal display, but it may also be a plasma display.

Also, in the exemplary embodiments described above, the description was given for the case of the image sensor 10 detecting the brightness, but it may detect chromaticity, and it may compare it with a predetermined reference value of chromaticity.

Also, in the exemplary embodiments described above, a description was given for the case of the image sensor 10 being provided outside of the image display device, but for example it may also be applied to the case of the image sensor being provided in a fixed manner to the image display device. In this case, the position of the image sensor may be measured in the same way as the process described above, and since the position is fixed, it may be input from the image sensor position input unit 20, and written in the position data storage unit 40 via the control unit 30 (or the control unit 35).

Also, in the aforementioned exemplary embodiments, it may be applied to not only a region that is no longer visible due to the image sensor, but for example to the case of an image being hidden by a person's shadow during use of a projector.

INDUSTRIAL APPLICABILITY

It is possible to apply it to an image display device in which an image sensor is provided.

The invention claimed is:

1. An image display device for displaying a first image on a screen including first and second regions different from each other, the image display device comprising:

a sensor position detecting unit that detects a position on a screen where an image sensor is provided, the position corresponding to the first region hidden by the image sensor; and an image processing unit that:

specifies the second region being contiguous with the position on the screen where the image sensor is provided;

by computing a difference between a total display region and the first region, calculates an image size of the second region;

computes an image size of the calculated second region and an image size of the first region, and generates a new image that reduces an obtained total image size to become the image size of the second region; and displays the new image at the second region.

2. The image display device according to claim 1, wherein the image processing unit performs display corresponding to a first image data on the screen, performs display corresponding to a second image data on a portion of the screen, and sequentially changes a position of displaying an image corresponding to the second image data within the image, and wherein the sensor position detecting unit judges whether or not a detection result corresponding to the second image data is obtained based on a detection result of the sensor position detecting unit, and in a case of the detection result corresponding to the second image data being obtained, the sensor position detecting unit detects that a position on the screen where the second image data is displayed when the detection result corresponding to the second image data is obtained, is a position on the image where the image sensor is provided.

3. The image display device according to claim 1, further comprising:

a pointer detecting unit that detects a position of a pointer that is displayed on the screen.

4. The image display device according to claim 1, further comprising:

a pointer detecting unit that detects a position of a pointer that is displayed on the screen, wherein, when the position of the pointer detected by the pointer detecting unit overlaps with the first region, the image processing unit displays a partial image at the second region.

5. The image display device according to claim 1, wherein the image processing unit performs display corresponding to a first image data on the screen, performs display corresponding to a second image data on a portion of the screen, and sequentially changes a position of displaying an image corresponding to the second image data within the image.

6. The image display device according to claim 5, wherein the sensor position detecting unit judges whether a detection result corresponding to the second image data is obtained based on a detection result of the sensor position detecting unit.

7. The image display device according to claim 6, wherein, in a case of the detection result corresponding to the second image data is obtained, the sensor position detecting unit detects that a position on the screen is a position on the image where the image sensor is provided.

8. The image display device according to claim 5, wherein, in a case of a detection result corresponding to the second image data is obtained, the sensor position detecting unit detects that a position on the screen where the second image data is displayed when the detection result corresponding to the second image data is obtained, is a position on the image where the image sensor is provided.

9. An image processing method for displaying a first image on a screen including first and second regions different from each other, the method comprising:

detecting, on a processor, a position on a screen where an image sensor is provided, the position corresponding to the first region hidden by the image sensor;

specifying the second region being contiguous with the position on the screen where the image sensor is provided;

calculating an image size of the second region by computing a difference between a total display region and the first region;

computing an image size of the calculated second region and an image size of the first region, and generating a new image that reduces an obtained total image size to become the image size of the second region; and displaying the new image at the second region.

10. The image processing method according to claim 9, wherein said displaying comprises performing display corresponding to a first image data on the screen, performing display corresponding to a second image data on a portion of the screen, and sequentially changing a position of displaying an image corresponding to the second image data within the image.

11. The image processing method according to claim 10, wherein said detecting comprises judging whether a detection result corresponding to the second image data is obtained based on a detection result of said detecting.

12. The image processing method according to claim 11, wherein, in a case of the detection result corresponding to the second image data is obtained, said detecting detects that a position on the screen is a position on the image where the image sensor is provided.

* * * * *